US006470656B2

(12) United States Patent
Huson et al.

(10) Patent No.: US 6,470,656 B2
(45) Date of Patent: Oct. 29, 2002

(54) FILM DELIVERY SYSTEM FOR PRESTRETCHED FILM

(75) Inventors: Gale W. Huson, Glenview, IL (US); John B. Petrash, Chicago, IL (US); Hugh J. Zentmyer, Green Oaks, IL (US)

(73) Assignee: Illinois Tool Works Inc., Glenview, IL (US)

( * ) Notice: Subject to any disclaimer, the term of this patent is extended or adjusted under 35 U.S.C. 154(b) by 105 days.

(21) Appl. No.: 09/725,826

(22) Filed: Nov. 29, 2000

(65) Prior Publication Data

US 2002/0062631 A1 May 30, 2002

(51) Int. Cl.[7] ..... B65B 41/12; B65B 11/00
(52) U.S. Cl. ..... 53/588; 53/389.2; 242/421.8
(58) Field of Search ..... 53/588, 389.2; 242/421.8, 422.8, 156.2

(56) References Cited

U.S. PATENT DOCUMENTS 2,920,840 A * 1/1960 Cooper ..... 242/156.2
3,076,618 A * 2/1963 Van Hook ..... 242/421.8
3,561,692 A * 2/1971 Henry ..... 242/421.8
3,731,889 A * 5/1973 Alexeff ..... 242/156.2
4,587,796 A 5/1986 Haloila
4,905,927 A * 3/1990 Lesse ..... 242/156.2
5,517,807 A 5/1996 Morantz
5,787,691 A 8/1998 Turfan et al.
6,315,234 B1 * 11/2001 Oishi ..... 242/421.8

* cited by examiner

*Primary Examiner*—Stephen F. Gerrity
(74) *Attorney, Agent, or Firm*—Schwartz & Weinrieb

(57) ABSTRACT

A film delivery system for use with plastic film wrapping apparatus for wrapping prestretched plastic film around a palletized load or article disposed at a wrapping station comprises a brake hub or pulley upon which a roll of plastic film material is mounted, and a single dancer or idler roller mounted for linear reciprocating movement upon a mounting plate and around which the plastic film material is routed from the roll of plastic film material to the load or article being wrapped. A brake band is disposed around the outer peripheral surface of the brake hub, and one end of the brake band is connected to a brake arm, while the other end of the brake band is connected to a brake adjustment spring. The brake arm is also connected to the single dancer or idler roller such that depending upon the linear disposition of the single dancer or idler roller during a plastic film wrapping operation, different braking or tension forces are impressed upon the brake hub and the plastic wrapping film material.

28 Claims, 6 Drawing Sheets

FIG. 3
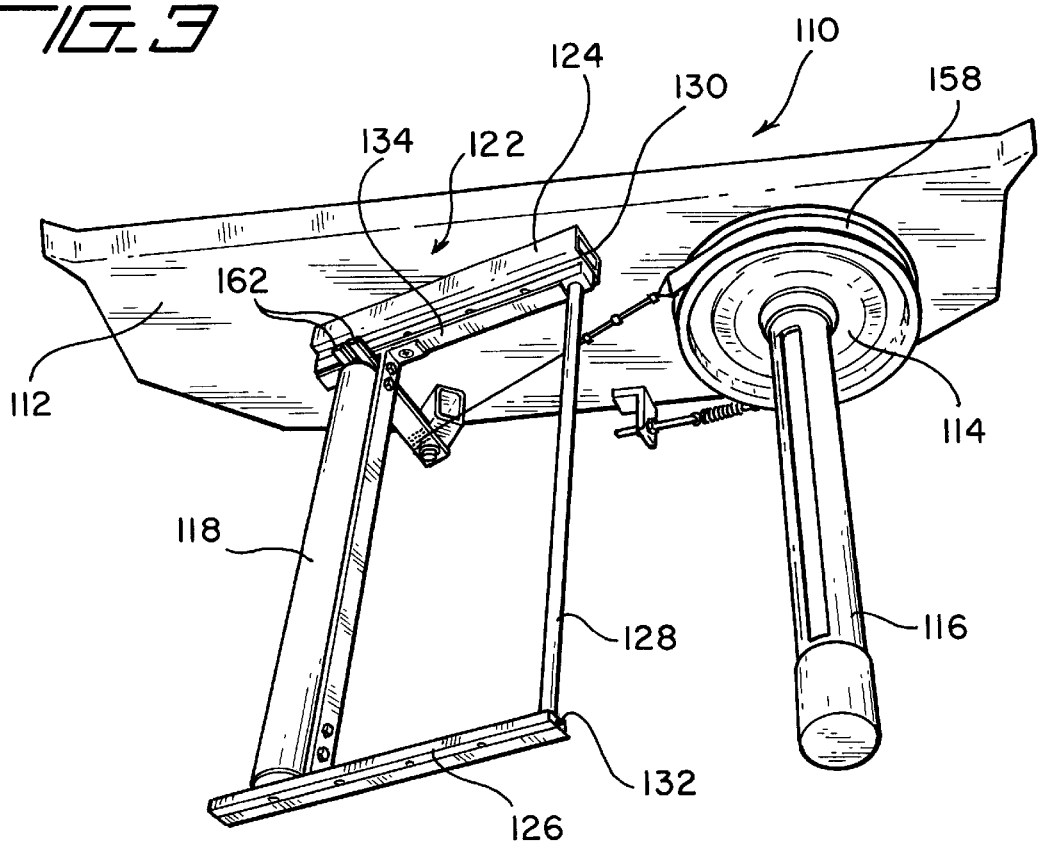
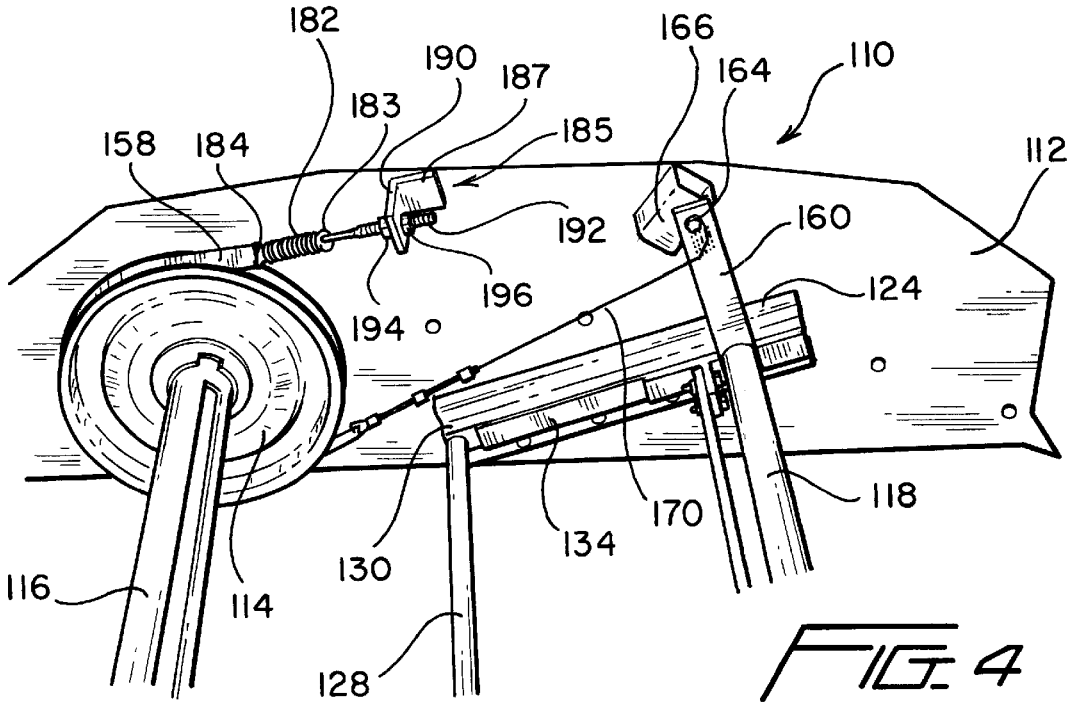
FIG. 4

FILM DELIVERY SYSTEM FOR PRESTRETCHED FILM

FIELD OF THE INVENTION

The present invention relates generally to stretch film wrapping apparatus which is used for wrapping stretch film material around palletized loads, products, articles, or packages disposed at a wrapping station of a stretch film wrapping facility, and more particularly to a new and improved film delivery system which dispenses prestretched film material from a stretch film supply roll that is mounted upon a film carriage assembly which, in turn, is mounted upon a vertically movable rotatable ring assembly through means of a suitable mounting plate, wherein the film delivery system comprises a new and improved brake mechanism which is operatively associated with the stretch film roll arbor upon which a stretch film supply roll is mounted so as to optimally predetermine, control, and balance the proper degree of tension or force-to-load parameters which are in effect being applied to or impressed upon the stretch film roll arbor, and the supply of stretch film material disposed upon a stretch film supply roll attached to the stretch film roll arbor and being dispensed from the stretch film supply roll, during a stretch film wrapping operation such that the tension or force-to-load parameters are substantially constant, or within a predetermined range of values, regardless of the amount of stretch film material remaining upon the stretch film material supply roll.

BACKGROUND OF THE INVENTION

Powered apparatus, for wrapping film material around palletized loads, products, packages, or articles which are disposed at a wrapping station of a wrapping or packaging facility, are of course well-known, and apparatus of the aforenoted type are disclosed within several patent publications, such as, for example, U.S. Pat. No. 4,587,796 which issued on May 13, 1986 to Haloila, U.S. Pat. No. 5,517,807 which issued on May 21, 1996 to Morantz, and U.S. Pat. No. 5,787,691 which issued on Aug. 4, 1998 to Turfan et al. As disclosed, for example, within FIG. 1 of the present patent application drawings, which corresponds to FIG. 1 of the aforenoted U.S. Pat. No. 5,517,807, the disclosure of such patent being incorporated herein by reference, it is briefly noted that an article to be wrapped within film material is disclosed at A and is located, in effect, at a wrapping station disposed upon a conveyor 18. The disclosed plastic film wrapping apparatus is seen to further comprise a stationary frame assembly 10, and a vertically movable frame assembly 12 which is mounted upon the stationary frame assembly 10 so as to be vertically movable with respect to the stationary frame assembly 10 as well as the load or article A to be wrapped and disposed at the wrapping station upon the conveyor 18. In addition, a rotatable ring member 14 is rotatably mounted upon the vertically movable frame assembly 12 so as to be vertically movable therewith with respect to the stationary frame assembly 10 and the article or load A to be wrapped and disposed at the wrapping station upon the conveyor 18, as well as to be rotatable around a vertical axis 16 with respect to the vertically movable frame assembly 12, the stationary frame assembly 10, and the article or load A to be wrapped and disposed at the wrapping station upon the conveyor 18. A film carriage assembly 28, upon which a plastic film material supply roll 30 is disposed, is in turn mounted upon the rotatable ring member 14 by means of a suitable mounting bracket, plate, or the like 29. In this manner, as the vertically movable frame assembly 12 is moved through its vertical operating range, and as the rotatable ring member 14 is likewise rotated around the vertical axis 16, the plastic film material disposed upon the plastic film material supply roll 30 is dispensed and wrapped around the article or load A disposed at the wrapping station upon the conveyor 18 so as to wrap the article or load A as desired.

It has been noted or experienced that while the aforenoted exemplary wrapping apparatus have of course performed satisfactorily and have been commercially successful, the aforenoted wrapping systems have not always been able to control or compensate for different tension or force-to-load requirements or wrapping load or force parameters attendant the wrapping of different portions or regions of a particular load, package, article, or product being wrapped due, for example, to different configurations or physical characteristics of the load, package, article or product as they are encountered during different times of the wrapping cycle. In addition, it has also been noted or experienced that the aforenoted wrapping systems have not always been able to control or compensate for the vastly different force-to-load or tension characteristics that are generated and impressed upon the film material throughout a particular article or load wrapping cycle, or alternatively, the vastly different force-to-load or tension characteristics that are generated and impressed upon the film material during different article or load wrapping cycles, due to the vastly different amounts of film material disposed or remaining upon the film material supply roll. It is well-known that a full roll of film material generates different force-to-load or tension characteristics or parameters than a substantially empty roll of film material. It is also known that it is imperative to control such tension or force-to-load characteristics, values, or parameters in order to ensure that the film material is wrapped around and upon the load, article, package, or product being wrapped with the proper degree or level of tension.

It is also known that, in accordance with conventional film dispensing and wrapping systems, the plastic film dispensed or withdrawn from its film supply roll is often routed or threaded around a multiplicity of film carriage rollers in order to provide or define a requisite amount of friction or tension between the film and the operative drive components of the system so as to prevent film slippage, slackness, or the like. The multiplicity of carriage rollers, however, are usually disposed within a substantially complex array with respect to each other which unfortunately renders the initial routing or threading of the film therethrough, such as, for example, when a new plastic film supply roll is being installed upon the wrapping apparatus, quite tedious, time-consuming, and dangerous for operator or maintenance personnel. The complexity of the film routing or threading also sometimes leads to errors in the actual routing or threading of the film with respect to the proper film route or threading path defined through the carriage rollers, and still further, the tediousness and time-consuming properties or characteristics of such apparatus lead to substantial production downtime of the film wrapping apparatus or system.

Still further, in connection with the provision of the conventional carriage rollers as noted hereinbefore, in order to obtain the aforenoted requisite amount of friction between the carriage rollers and the plastic wrapping film being dispensed or withdrawn from its film supply roll, the outer peripheral surface portions of the carriage rollers are often conventionally provided with raised or embossed mechanical projections or friction-generating surface portions which are adapted to engage the plastic film so as to minimize any slippage of the film relative to the conveying carriage rollers. Slippage between the carriage rollers and the plastic film being conveyed thereby does nevertheless occur, and accordingly, minute amounts of film particles or film additives become separated from the film material as a result of the frictional forces generated by means of the aforenoted raised or embossed mechanical projections or friction-engaging surface portions of the carriage rollers acting upon the plastic film. The surface portions of the carriage rollers therefore tend to become clogged with such film particles or additives, and such particles or additives also tend to adhere to the surface portions of the carriage rollers thereby in effect rendering the same useless from a friction-generating point of view. Still yet further, the raised or embossed mechanical projections or friction-generating surface portions of the carriage rollers also tend to in effect etch or permanently emboss mirror images of their patterns into surface portions of the plastic film as the film is conducted or travels around the outer peripheral surface portions of the carriage rollers. This is undesirable in that such patterns, which are in effect etched, embossed, or impressed upon the plastic film by means of the carriage rollers, operatively interfere with the proper reading, for example, of bar-code type labels, which are often placed directly upon the palletized loads, products, packages, or articles before the same are wrapped within the plastic wrapping film so as to enable or facilitate downstream routing, transporting, or sorting of the palletized loads, products, packages, or articles, in view of the fact that the etched, embossed, or impressed patterns tend to scatter ambient light thus rendering the bar-code type labels unreadable.

A need therefore exists in the art for a new and improved film delivery system which can dispense film material from a film material supply roll in such a manner that the tension or force-to-load characteristics or parameters generated or impressed upon the film material can be maintained substantially constant or within a predetermined range of values regardless of any variable configurations or physical characteristics of the load, package, article or product being wrapped, and/or concomitantly, regardless of the different amounts of film material that are disposed or that remain upon the film material supply roll as the film material is dispensed from the film material supply roll during a particular article or load wrapping cycle, or alternatively, during different article or load wrapping cycles. An additional need exists in the art for a carriage roller assembly which renders the routing or threading of the plastic film therearound relatively simple, quick, safe for installation or maintenance personnel, and less tedious and time-consuming, and in addition, provides the necessary or requisite amount of friction drive with respect to the dispensed or tensioned film without adversely affecting or marring the surface portions or characteristics of the plastic film so as to enable the wrapped products, packages, loads, or articles to nevertheless be routed, sorted, or transported by means of, for example, bar-code reading techniques and apparatus.

OBJECTS OF THE INVENTION

Accordingly, it is an object of the present invention to provide a new and improved stretch film wrapping apparatus for wrapping stretch film material around palletized loads, products, articles, or packages, and a new and improved film delivery system incorporated within such apparatus.

Another object of the present invention is to provide a new and improved stretch film wrapping apparatus for wrapping stretch film material around palletized loads, articles, products, or packages, and a new and improved film delivery system incorporated within such apparatus wherein such apparatus and the film delivery system thereof effectively overcome the various aforenoted operational drawbacks characteristic of conventional or prior art apparatus or systems.

An additional object of the present invention is to provide a new and improved stretch film wrapping apparatus for wrapping stretch film material around palletized loads, articles, products, or packages, and a new and improved film delivery system incorporated within such apparatus wherein such apparatus and the film delivery system thereof effectively overcome the various aforenoted operational drawbacks characteristic of conventional or prior art apparatus or systems by providing a means for substantially generating constant force-to-load tension characteristics or parameters upon the film material during a wrapping cycle regardless of particularly unique structural configurations of the loads, products, articles, or packages being wrapped, or regardless or independent of the amount of stretch film material disposed or remaining upon the stretch film material supply roll.

A further object of the present invention is to provide a new and improved stretch film wrapping apparatus for wrapping stretch film material around palletized loads, articles, products, or packages, and a new and improved film delivery system incorporated within such apparatus wherein such apparatus and the film delivery system thereof effectively overcome the various aforenoted operational drawbacks characteristic of conventional or prior art apparatus or systems by providing an automatically compensating braking mechanism which is operatively connected to the stretch film supply roll arbor, upon which the stretch film supply roll is mounted, for substantially generating constant force-to-load tension characteristics or parameters upon the film material during a wrapping cycle regardless of particularly unique structural configurations of the loads, products, articles, or packages being wrapped, or regardless or independent of the amount of stretch film material disposed or remaining upon the stretch film material supply roll.

A yet further object of the present invention is to provide a new and improved stretch film wrapping apparatus for wrapping stretch film material around palletized loads, articles, products, or packages, and a new and improved film delivery system incorporated within such apparatus wherein such apparatus and the film delivery system thereof effectively overcome the various aforenoted operational drawbacks characteristic of conventional or prior art apparatus or systems by providing an automatically compensating braking mechanism which is operatively connected to the stretch film supply roll arbor, upon which the stretch film supply roll is mounted, and wherein further, such apparatus and the film delivery system thereof comprises a single idler or dancer roller assembly which simplifies the routing or threading of the plastic film material therearound and which does not adversely etch, emboss, impress, or mar the surfaces of the plastic film so as not to, in turn, compromise the readability of bar-code type labels secured upon the wrapped loads, packages, products, or articles.

SUMMARY OF THE INVENTION

The foregoing and other objectives are achieved in accordance with the teachings and principles of the present invention through the provision of a new and improved prestretched film wrapping apparatus for wrapping prestretched film material around palletized loads, articles, products, or packages, and a new and improved film delivery system incorporated within such apparatus, wherein such apparatus and the film delivery system thereof comprises a brake hub or pulley which is rotatably mounted upon a mounting plate of a film carriage assembly. The film carriage assembly is mounted upon a rotatable ring member which is mounted upon a vertically movable frame member of the film wrapping apparatus. A film roll arbor, upon which a film supply roll is fixedly mounted, is in turn fixedly mounted upon the brake hub or pulley, and a single idler or dancer roller is mounted for linear movement upon the mounting plate by means of spring-biased track or channel assemblies. The idler or dancer roller is also operatively connected to a first end of a brake arm which is pivotally mounted at its second opposite end upon the mounting plate, and a brake band is adapted to be disposed around an outer peripheral portion of the brake hub or pulley. A first end of the brake band is connected to a first end of a brake cable, while a second opposite end of the brake cable is fixedly connected to the second end of the brake arm. In a similar manner, a first end of a brake adjustment spring is connected to the second end of the brake band, while a second end of the brake adjustment spring is connected to an adjustment mechanism which is fixedly mounted upon the mounting plate. The prestretched film is withdrawn from its supply roll mounted upon the film arbor, routed around the idler or dancer roller, and conducted toward the load, package, product, or article being wrapped.

When the rotatable ring member of the wrapping apparatus is rotated, the idler or dancer roller is moved against the biasing forces of its channel or track-mounted spring members causing, in turn, pivotal movement of the brake arm so as to effectively release the brake band from its engaged position with the brake hub whereby the prestretched film is permitted to be dispensed. When rotation of the rotatable ring member of the wrapping apparatus is terminated, the channel or track-mounted spring members cause the idler or dancer roller to be moved toward its initial position at which position the brake arm is, in turn, caused to be moved toward its initial position whereby the brake band again engages the brake hub so as to arrest further dispensing of the prestretched film from the film supply roll. During a particular wrapping cycle, any variable forces operating upon the film material, either as a result of particular structural configurations or the like of the load, package, product, or article being wrapped, or as a result of the amount of film disposed or remaining upon the film supply roll, are automatically compensated for by means of the spring-biased idler or dancer roller as determined by means of the biasing forces of its channel or track-mounted spring members as well as the initial adjustment of the brake cable-brake band-adjustment brake spring assembly. In addition, as a result of the provision of a single idler or dancer roller assembly, the routing or threading of the prestretched film around the idler or dancer roller assembly is simplified and rendered relatively safe and quick. Still further, as a result of providing the outer peripheral surface portions of the idler or dancer roller with a highly-polished mirror-type surface finish to which the prestretched film can effectively adhere under atmospheric conditions, no mechanical projections or friction-generating surface embossments are required to be provided upon the idler or dancer roller in order to in effect frictionally engage and drive the prestretched film as the same is being dispensed from its film supply roll upon the film carriage assembly.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 3 is a bottom, upward-looking perspective view of the new and improved film delivery system as shown in FIG. 2 and viewed from an interior side of the delivery system as the delivery system rotates along its arcuate path around the palletized load, product, package, or article being wrapped in accordance with the rotational movement of the rotatable ring member of the film wrapping apparatus;

FIG. 4 is a bottom, upward-looking perspective view of the new and improved film delivery system as shown in FIG. 2 and similar to FIG. 3 showing, however, the various components of the delivery system as viewed from an exterior side of the delivery system as the delivery system rotates along its arcuate path around the palletized load, product, package, or article being wrapped in accordance with the rotational movement of the rotatable ring member of the film wrapping apparatus;

FIG. 8 is an enlarged bottom, upward-looking perspective view of the new and improved film delivery system as shown in FIG. 4 and showing in particular the details of the brake band adjustment mechanism of the film delivery system as mounted upon the mounting plate of the film delivery system;

DETAILED DESCRIPTION OF THE PREFERRED EMBODIMENT

Figure 1:
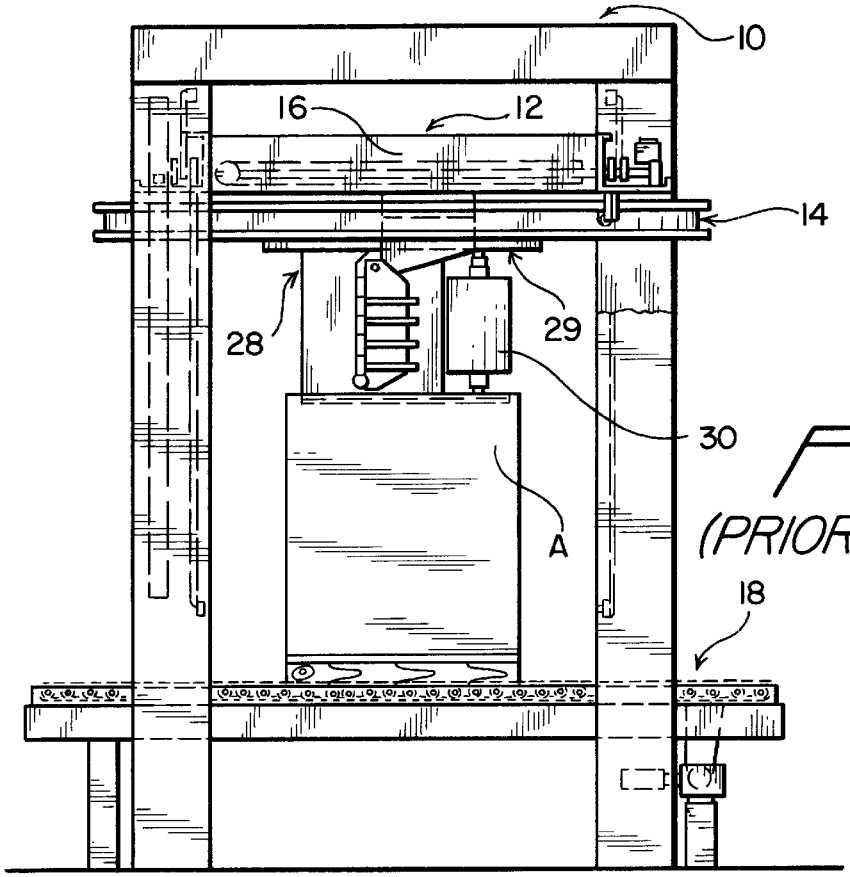
FIG. 1 (PRIOR ART)
FIG. 1 is a side elevational view of a PRIOR ART film wrapping apparatus of the type within which the new and improved film delivery system of the present invention can be incorporated.

Referring now to the drawings, and more particularly to FIGS. 2–8 thereof, the new and improved film delivery system, constructed in accordance with the principles and teachings of the present invention, is disclosed and is generally indicated by the reference character 110. More particularly, it is seen that the new and improved film delivery system 110 comprises a mounting plate 112 which is similar to the mounting plate 29 of the aforenoted Morantz patent and is therefore adapted to be fixedly secured or mounted upon a rotatable ring member which is not shown but which is similar to the rotatable ring member 14 of the aforenoted Morantz patent. A brake hub or pulley 114 is rotatably mounted upon the mounting plate 112, and a downwardly extending film arbor 116 is fixedly mounted upon the brake hub or pulley 114 so as to be rotatable with the brake hub or pulley 114. The film arbor 116 is adapted to be inserted within the axial tubular or core portion of a prestretched plastic film material supply roll 117 so as to enable mounting of the prestretched plastic film material supply roll 117 thereon, and it is noted that the diametrical extent of the brake hub or pulley 114 is substantially greater than the diametrical extent of the prestretched plastic film material supply roll 117 for a purpose which will be discussed further in detail hereinafter. In particular, for example, a typical fresh or new prestretched plastic film material supply roll 117 may have a diametrical extent of approximately nine inches (9"), whereas the diametrical extent of the brake hub or pulley 114 is within the range of approximately twelve to fifteen inches (12–15").

Figure 2:
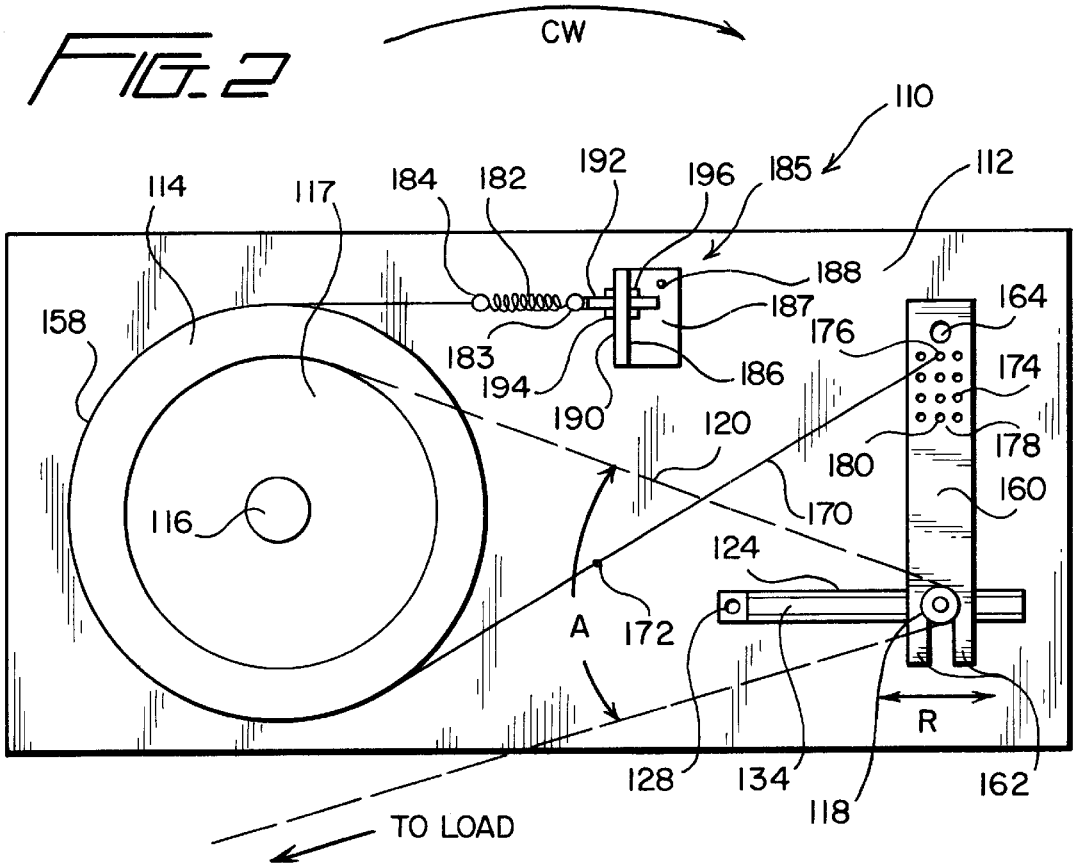
FIG. 2 is a schematic, bottom plan view of the new and improved film delivery system constructed in accordance with the principles and teachings of the present invention and showing the cooperative parts thereof.
Figure 6:
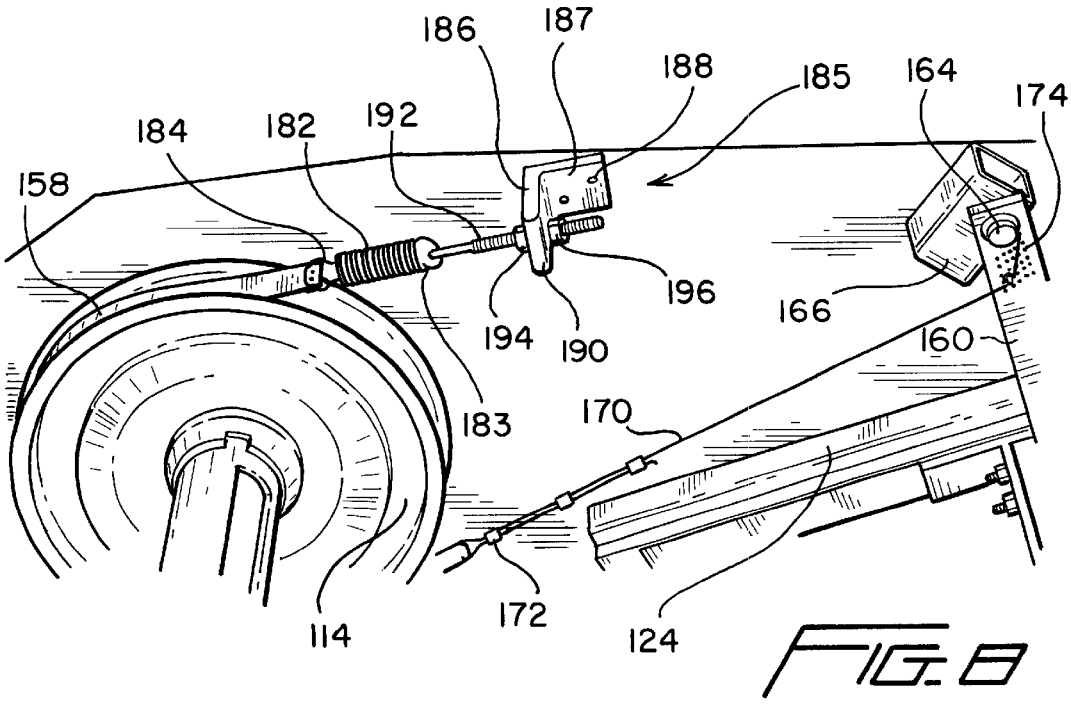
FIG. 6 is an enlarged bottom, upward-looking perspective view of the new and improved film delivery system as shown in FIG. 4 and showing in particular the details of the brake arm and the idler or dancer roller components of the film delivery system as mounted upon the mounting plate of the film delivery system.

The film delivery system 110 is seen to further comprise a single vertically oriented idler or dancer roller 118 around which the prestretched plastic film material 120, which is shown in phantom lines in FIG. 2 and which is to be dispensed or withdrawn from the prestretched plastic film material roll 117, is routed, threaded, and conducted. It is noted that the prestretched plastic film material 120 is in fact routed or threaded around the single idler or dancer roller 118 so as to encompass or comprise, in effect, a sole reversal or single 180° change in direction as the prestretched plastic film material 120 is directed or conducted toward the palletized load, package, product, or article to be wrapped. In reality, the angle A defined between the path of the plastic film material 120 as the same is withdrawn from the plastic film material supply roll 117 and the path of the plastic film material 120 as the same is conducted toward the load, package, product, or article being wrapped is approximately 40°. It is especially noted that as a result of the provision of the single idler or dancer roller 118 around which the prestretched plastic film material 120 is routed or threaded in accordance with the aforenoted directional reversal or 180° conveyance or routing mode, the prestretched plastic film material 120 may be easily, readily, quickly, and safely threaded or routed around the single idler or dancer roller 118 without necessitating the implementation of complicated or intricate routing or threading operations. Accordingly, the installation of a new or fresh prestretched plastic film material supply roll 117 may be achieved in a safe manner and in a relatively short period of time whereby substantial downtime of the wrapping apparatus is obviated.

With reference being particularly made to FIGS. 3–8, it is seen that opposite upper and lower ends of the single, vertically oriented idler or dancer roller 118 are mounted within a vertically dependent, substantially C-shaped idler or dancer roller framework assembly 122. More particularly, the idler or dancer roller framework assembly 122 is seen to comprise a pair of upper and lower horizontally disposed track or channel frame members 124,126, which are disposed parallel to each other in a vertically spaced manner, and a first vertically disposed frame member or guide track weldment 128 which rigidly interconnects first ends 130,132 of the upper and lower track or channel members 124, 126 which are disposed closest to the brake hub or pulley 114 and the prestretched plastic film material supply roll 117 mounted thereon. As may best be seen or appreciated from FIGS. 3, 4, and 6–8, the upper track or channel frame member 124 is provided with or has defined therein an upper track or channel portion 134 which is effectively closed at the first end 130 of the upper track or channel frame member 124, and the lower track or channel frame member 126 is similarly provided with or has defined therein a lower track or channel portion, not actually shown or visible in the drawings, which is likewise effectively closed at the first end 132 of the lower track or channel frame member 126.

Figure 7:
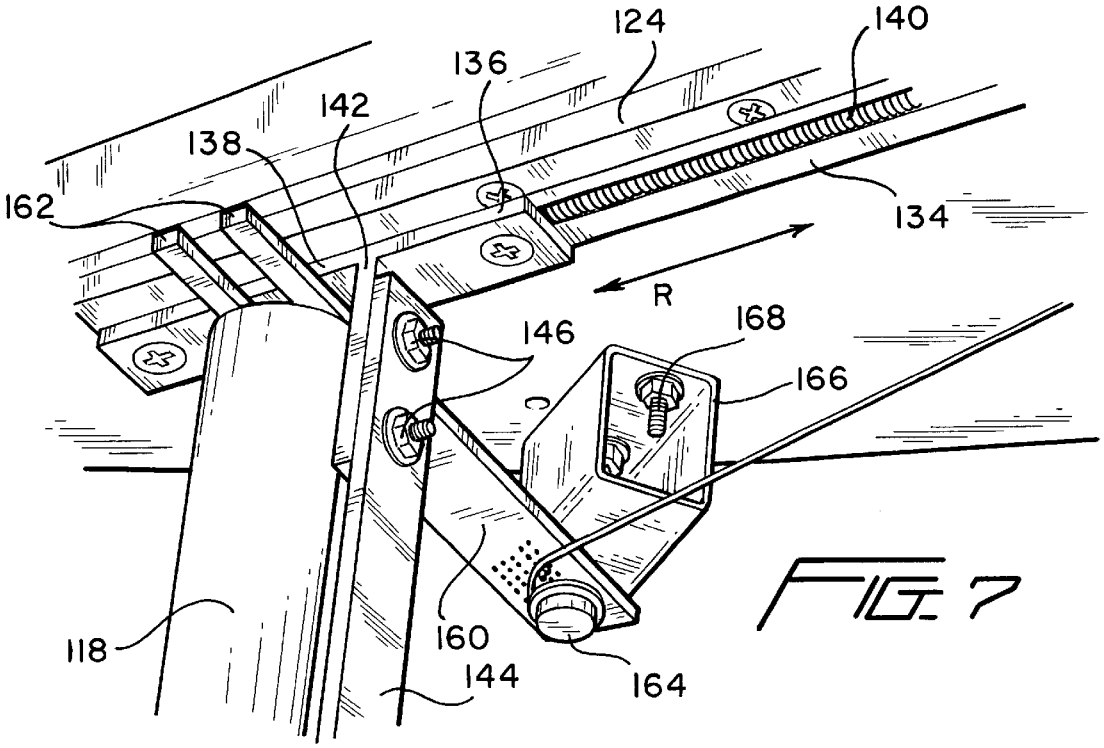
FIG. 7 is an enlarged bottom, upward-looking perspective view of the new and improved film delivery system as shown in FIG. 3 and showing in particular the details of the brake arm and the idler or dancer roller components of the film delivery system as mounted upon the mounting plate of the film delivery system.
Figure 10:
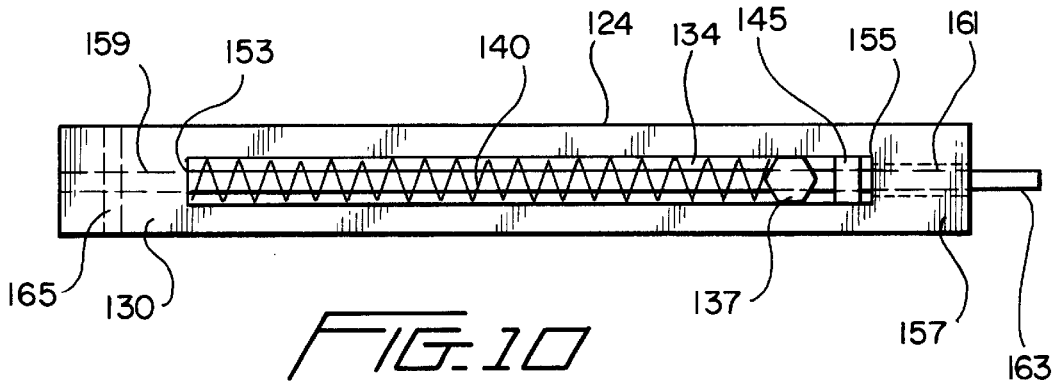
FIG. 10 is a schematic top plan view corresponding to the schematic side elevational of the idler or dancer roller framework assembly as shown in FIG. 9 and showing additional details of the mounting of the idler or dancer roller within the idler or dancer roller framework assembly.
Figure 9:
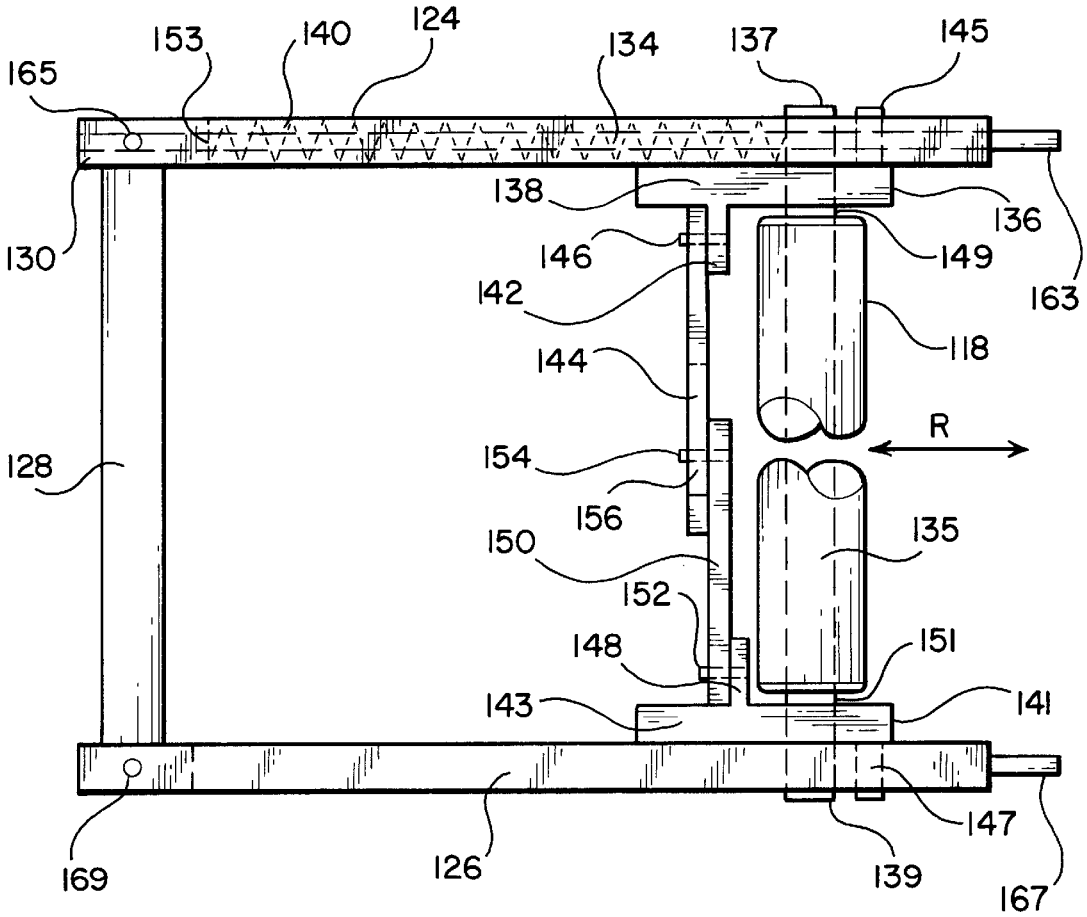
FIG. 9 is a schematic side elevational view of the idler or dancer roller framework assembly showing some of the details of the idler or dancer roller framework assembly by means of which the idler or dancer roller is movably mounted within the idler or dancer roller framework assembly.

As may best be seen or appreciated from FIGS. 7, 9, and 10, the idler or dancer roller 118 is provided with an axially extending, two-piece, spring-biased roller shaft 135, and it is seen that an upper end portion 137 of the roller shaft 135 projects upwardly through a horizontally disposed web portion 138 of a first substantially T-shaped upper mounting bracket 136 as well as through the upper track or channel portion 134 of the upper track or channel frame member 124, while a lower end portion 139 of the roller shaft 135 similarly projects downwardly through a horizontally disposed web portion 143 of a second substantially T-shaped lower mounting bracket 141 as well as through the lower track or channel portion, not shown, defined within the lower track or channel frame member 126. The horizontally disposed web portion 138 of the upper mounting bracket 136, and the horizontally disposed web portion 143 of the lower mounting bracket 141, are adapted to be slidably mounted upon the upper and lower track or channel frame members 124,126, and each one of the horizontally disposed web portions 138,143 of the upper and lower mounting brackets 136,141 is respectively provided with an upwardly and downwardly projecting guide pin 145,147 which is adapted to be respectively disposed within the upper track or channel portion 134, and the lower track or channel portion, not shown, so as to cooperate with the upper and lower end portions 137,139 of the roller shaft 135 for guided movement within the upper track or channel portion 134, and the lower track or channel portion, not shown, during relative movement of the idler or dancer roller 118 with respect to its framework assembly 122 as will become more apparent hereinafter.

It is noted that the two-piece, spring-biased arrangement of the roller shaft 135 permits tools, not shown, to be impressed upon the opposite ends 137,139 of the roller shaft 135 so as to, in effect, facilitate axial compression of the opposite ends 137,139 of the roller shaft 135 toward each other whereby the roller shaft 135 can be easily removed from or mounted upon the upper and lower mounting brackets 136,141. In order to gain access to, for example, the upper end 137 of the roller shaft 135, the upper track or channel frame member 124 is mounted upon the mounting plate 112 through means of a suitable spacer, not shown, whereby the upper surface portion of the upper track or channel frame member 124 is effectively spaced from the underside or undersurface portion of the mounting plate 112. It is also noted that the external peripheral surface of the opposite ends 137,139 of the roller shaft 135 have hexagonal geometrical configurations, and that the distance defined between oppositely disposed or facing surfaces, sides, or facets of the hexagon is just slightly less than the width of the upper track or channel portion 134, as well as that of the lower track or channel portion, not shown, such that the opposite ends 137,139 of the roller shaft 135 can be disposed within the upper track or channel portion 134, as well as within the lower track or channel portion, not shown, while not permitting relative rotation to occur therebetween. In order to of course provide for the free rotation of the idler or dancer roller 118 with respect to the roller shaft 135 and mounting brackets 136,141, opposite ends of the idler or dancer roller 118 are respectively provided with suitable bearing members generally indicated at 149,151.

A first upper spring member 140 is disposed within the upper track or channel portion 134 of the upper track or channel frame member 124, and a similar second spring member, not shown, is likewise disposed within the lower track or channel portion, not shown, of the lower track or channel frame member 126 so as to effectively operatively bias the dancer or idler roller 118, through means of the opposite ends 137,139 of the roller shaft 135, toward its normal position remote from the vertically disposed frame member or guide track weldment 128 as shown in FIG. 9. Accordingly, a description of the interaction of the first upper spring member 140 with respect to its respective components will now be described, however, it is to be noted that a similar operative arrangement is correspondingly present with respect to the second spring member, not shown, disposed within the lower track or channel portion, not shown, of the lower track or channel frame member 126. More particularly, a first end of the first upper spring member 140 is operatively engaged with an interior wall 153 of the first closed end 130 of the upper channel or track frame member 124, while a second opposite end of the first upper spring member 140 is operatively engaged with the upper end portion 137 of the roller shaft 135. In this manner, the upper idler or dancer roller subassembly, comprising the idler or dancer roller 118, the upper mounting bracket 136, and the upper guide pin 145 are biased toward the right as viewed, for example, within FIG. 9, until the upper guide pin 145 is disposed in contact with an interior wall 155 of a second closed end 157 of the upper channel or track frame member 124. In order to complete the operative biased mounting of the upper end portion 137 of the roller shaft 135 within the upper channel or track frame member 124, the first closed end 130 of the upper channel or track frame member 124 is provided with a blind bore 159, and the second closed end 157 of the upper channel or track frame member 124 is provided with a through-bore 161 which is coaxially disposed with respect to the blind bore 159. A first upper guide rod 163 is disposed within the upper channel or track portion 134 of the upper channel or track frame member 124 and has its opposite ends disposed within the bores 159,161, the end of the guide rod 163 disposed within the blind bore 159 being fixedly secured therein by means of a transversely disposed bolt or similar fastener 165. In addition, the upper guide rod 163 also passes through apertures defined within the upper end portion 137 of the roller shaft 135 and the upper guide pin 145, and the upper coil spring member 140 is coaxially disposed upon the guide rod 163.

Accordingly, the upper end portion 137 of the roller shaft 135 and the upper guide pin 145 are in effect free to ride or slide along the upper guide rod 163 in accordance with forces impressed upon the idler or dancer roller 118 during a prestretched film wrapping cycle so as to effectively compress the upper coil spring member 140, or alternatively, in accordance with the biasing forces of the upper coil spring member 140 tending to return the idler or dancer roller 118 toward its normal position illustrated in FIG. 9. It is to be remembered that a similar structural arrangement, not entirely shown, is provided in connection with the lower channel or track frame member 126, the lower end portion 139 of the roller shaft 135, and the lower guide pin 147, and accordingly, a second lower guide rod 167 and a transversely disposed bolt or other similar fastener 169 are illustrated in FIG. 9 in conjunction with the lower channel or track frame member 126. In order to complete the entire idler or dancer roller framework assembly 122, a first vertically disposed web portion 142 of the upper mounting bracket member 136 is adapted to be fixedly secured to a first vertically extending roller mount frame member 144 by means of a plurality of suitable bolt or other type of fastener 146, and similarly, a second vertically disposed web portion 148 of the lower mounting bracket member 141 is adapted to be fixedly secured to a second vertically extending roller mount frame member 150 by means of a plurality of suitable fasteners 152.

It is noted that while a single roller mount frame member may be provided as is shown, for example, within FIGS. 3 and 4, as at 144, the provision of the roller mount framework as a two-piece roller mount framework comprising the first and second vertically extending roller mount frame members 144,150 is preferable because such a system provides several operational advantages. For example, a first advantage achieved by means of the dual or two-piece roller mount framework comprising the first and second vertically extending roller mount frame members 144,150 permits ease of installation of the various idler roller and framework components within a relatively confined workspace defined between the upper and lower track or channel frame members 124,126. A second advantage of such a dual or two-piece roller mount framework resides in the fact that positional adjustment of the various framework components with respect to the upper and lower track or channel framework members 124,126 can be readily achieved so as to, for example, properly position the upper and lower mounting brackets 136,141 for their sliding movement upon the upper and lower track or channel framework members 124,126. Lastly, the positional adjustment afforded by means of the aforenoted dual or two-piece roller mount framework obviates the need for extremely tight or critical manufacturing tolerances to be adhered to or achieved. Accordingly, when the pair of roller mount frame members 144,150 are employed, then the roller mount frame members 144,150 are overlapped with respect to each other in the vertical direction, and are fixedly connected to each other by means of a suitable fastener 154, mounted upon for example frame member 150, being adjustably disposed within for example a slot 156 formed within the frame member 144. In this manner, the integrated idler or dancer roller framework assembly 122 is formed and facilitates the linear reciprocating movement of the idler or dancer roller 118 within the upper and lower track or channel frame members 124, 126, as denoted by means of the double-headed arrow R shown in FIGS. 7 and 9, during various operative times, or in accordance with various operative parameters, characteristic of or attendant a prestretched plastic film wrapping operation or cycle as determined, in effect, by means of the rotation of the rotatable ring member of the plastic film wrapping apparatus, as will be discussed still further hereinafter.

It is to be further noted that the idler or dancer roller 118 is fabricated from stainless steel, and that the outer peripheral surface of the idler or dancer roller 118 is highly polished so as to achieve or exhibit an extremely smooth mirror-finish. In this manner, as the prestretched plastic film material 120 is routed, threaded, or conducted around the outer peripheral surface of the idler or dancer roller 118, and conveyed from its supply roll 117 to the palletized load, article, package, or product being wrapped, the prestretched plastic film material 120 does not encounter any mechanical projections or embossed surface portions as was characteristic of the prior art roller components.

Accordingly, the surface characteristics and light-transmitting or refracting properties of the prestretched plastic film material 120 are not adversely affected. In addition, the conveyance of the prestretched plastic film material 120 along its path in a relatively non-slip mode or manner with respect to the idler or dancer roller 118 during a packaging or wrapping operation is likewise not adversely affected and is in fact achieved. The reason for this is that as a result of the provision of the mirror-finish upon the outer peripheral surface of the idler or dancer roller 118, good frictional engagement between the outer peripheral surface of the idler or dancer roller 118 and the inner surface of the prestretched plastic film material 120 is in fact able to be attained and is effectively enhanced. More particularly, as a result of the provision of the mirror-finish upon the outer peripheral surface of the idler or dancer roller 118, no minute pockets or recesses, within which air can accumulate, are defined within or formed upon the outer peripheral surface portion of the idler or dancer roller 118. Accordingly, the plastic film material 120 readily adheres to the outer peripheral surface portion of the idler or dancer roller 118 under normal atmospheric pressure conditions.

Figure 11:
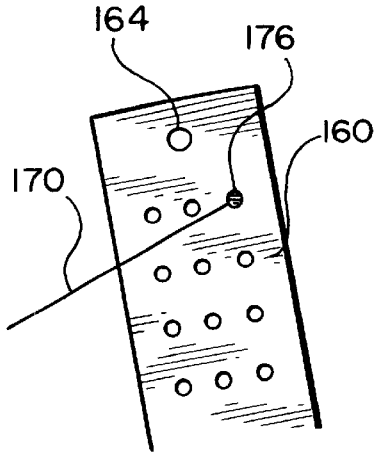
FIG. 11 is a schematic view of the brake arm and brake cable components of the film delivery system wherein the brake cable is operatively connected to the brake arm in accordance with a first connection mode for achieving a first mode of adjustment of the brake cable.

Continuing further, and with reference again being made to FIGS. 2–8 of the drawings, further details of a substantially constant or balanced force-to-load braking and biasing system, developed in accordance with the principles and teachings of the present invention, as well as the particularly unique structural arrangement of the various components of the present invention, will now be described. More particularly, it is seen that a brake band 158 is disposed about the external periphery of the brake hub or pulley 114, and a brake arm 160 has a first end thereof operatively engaged with the upper end 137 of the roller shaft 135 as best seen in FIG. 7. The first end of the brake arm 160 is provided with a forked, bifurcated, or tined configuration wherein the laterally spaced tines 162,162 are disposed upon opposite sides of the upper end 137 of the roller shaft 135 as may be best envisioned from FIG. 7, while the second opposite end of the brake arm 160 is pivotally mounted as at 164 upon a tubular mounting bracket 166 which is fixedly secured to the underside or undersurface of the mounting plate 112 by means of suitable bolt fasteners 168. A first end of the brake band 158 is connected to a first end of a brake cable 170 as at 172, while a second end of the brake cable 170 is connected to the second end of the brake arm 160. A plurality of holes or apertures 174 are defined within the second end of the brake arm 160 in the form of a grid comprising rows or columns, and the second end of the brake cable 170 is adapted to be fixedly connected to the second end of the brake arm 160 as a result of being fixed, for example, within the corner one 176 of the holes or apertures 174 which is remotest from the connection 172 with the brake band 158 as may best be appreciated from FIGS. 2 and 11 in order to attain a predetermined amount of braking tension as will become more apparent hereinafter.

Figure 13:
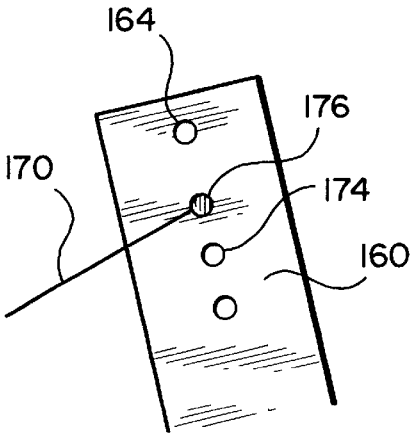
FIG. 13 is a schematic view of the brake arm component of the film delivery system wherein the brake arm is provided with an alternative array of apertures within which the end of the brake cable may be secured in accordance with a third connection mode for achieving a third mode of adjustment of the brake cable.
Figure 12:
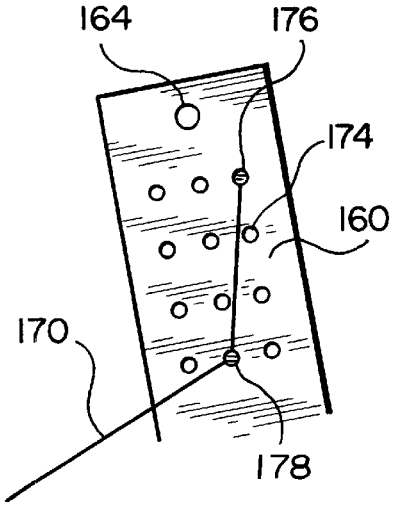
FIG. 12 is a schematic view of the brake arm and brake cable components of the film delivery system wherein the brake cable is operatively connected to the brake arm in accordance with a second connection mode for achieving a second mode of adjustment of the brake cable.
Figure 6:
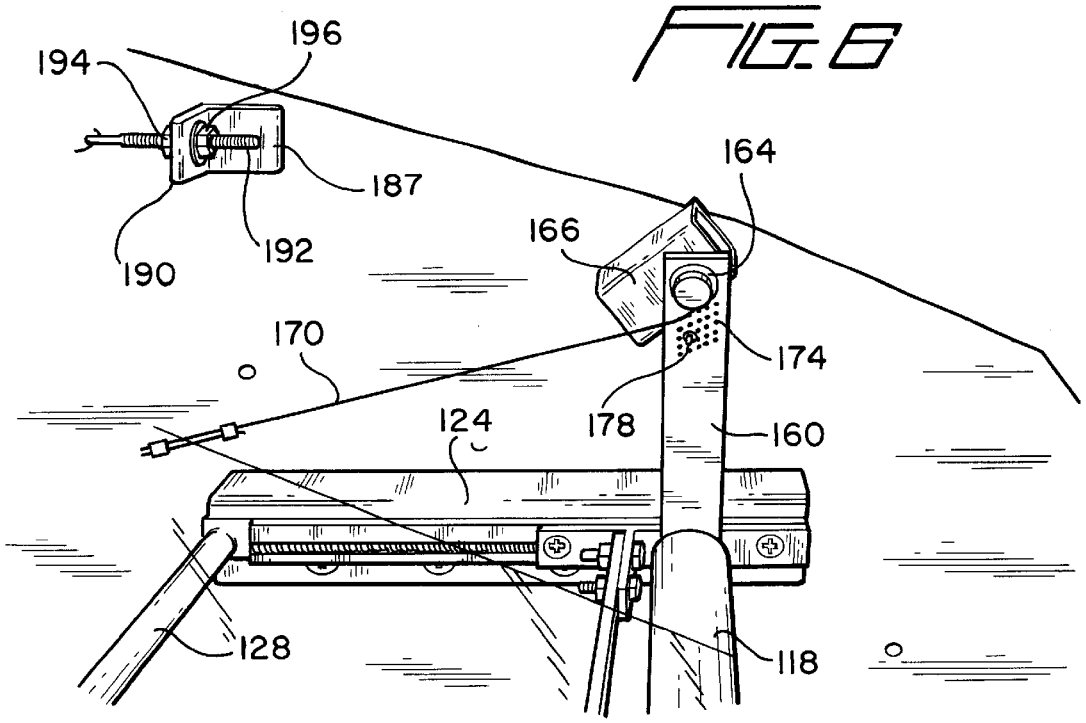

Alternatively, a plug 178 may be placed within, for example, another hole or aperture 180 of the grid pattern of holes or apertures 174, and when, for example, the plug 178 is placed within the hole or aperture 180 which is closer to the operative connection of the brake arm 160 with the dancer or idler roller 118, as may best be seen or appreciated from FIG. 12, and when the brake cable 170 is routed around the plug 178, it can be clearly seen or appreciated that the length of the brake cable 170 will in effect be shortened so as to alter the tension with which the brake band 158 is engaged with the brake hub or pulley 114. In addition, in this manner, the length of time during which the brake band 158 remains engaged with the brake hub or pulley 114 is altered so as to derive or generate different braking forces which are to be impressed upon the brake hub or pulley 114 in connection with the linear movement of the idler or dancer roller 118 within its upper and lower track or channel frame members 124,126 and the resulting pivotal movement of the brake arm 160 around its pivotal connection 164. In lieu of the grid pattern of holes or apertures as disclosed, for example within FIGS. 11 and 12, a single column of holes or apertures 174 may be provided within the brake arm 160 as shown in FIG. 13 whereby similar braking forces may also be generated and impressed upon the brake hub or pulley 114 through means of the brake band 158. Alternatively still further, and in order to cause the generation or transmission of still different braking forces upon the brake band 158, the second end of the brake cable 170 may be fixedly secured within the hole or aperture 180 while the plug 178 may be disposed within any one of the other holes or apertures 174.

Figure 5:
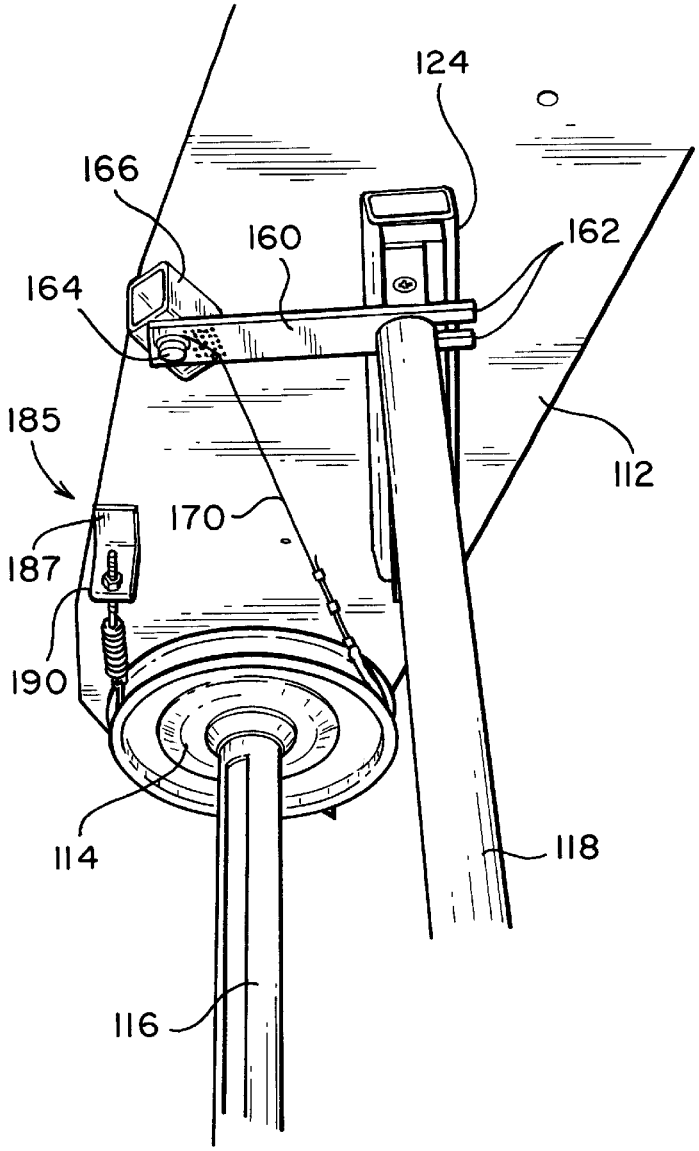
FIG. 5 is a bottom, upward-looking perspective view of the new and improved film delivery system as shown in FIG. 2 and similar to FIGS. 3 and 4 showing, however, the various components of the delivery system as viewed from an end of the delivery system as the delivery system rotates along its arcuate path around the palletized load, product, package, or article being wrapped in accordance with the rotational movement of the rotatable ring member of the film wrapping apparatus.

Continuing still further, the second opposite end of the brake band 158 is operatively connected to a first end of a brake adjustment spring 182 as at 184, and the second end 183 of the brake adjustment spring 182 is adjustably connected to a brake spring adjustment assembly 185. The brake spring adjustment assembly 185 comprises a substantially L-shaped brake adjustment spring mounting bracket 186 which has a first leg 187 thereof fixedly secured to the underside or undersurface portion of the mounting plate 112 by means of suitable fasteners 188 as best seen in FIGS. 4, 5, and 8. More particularly, the second leg 190 of the brake adjustment spring mounting bracket 186 which is not directly secured or fixed to the mounting plate 112 is provided with a throughbore, not actually shown, through which an adjustment screw 192 is freely disposed. A pair of adjustment nuts 194,196 are threadedly engaged upon the adjustment screw 192 so as to be disposed upon opposite sides of the second leg 190 of the brake adjustment spring mounting bracket 186. Accordingly, in order to achieve adjustment of the brake adjustment spring 182, and the inherent spring force or tension characteristics thereof, the nuts 194,196 are initially loosened, the externally threaded adjustment screw 192 is axially moved relative to the mounting bracket leg 190, and the adjustment nuts 194,196 are again tightened so as to secure the adjustment screw 192 at the desired axial position with respect to the mounting bracket leg 190, the adjustment nuts 194,196 thereby preventing any axial movement of the threaded adjustment screw 192 with respect to the mounting bracket leg 190 once the nuts 194,196 are threadedly moved into engagement with their respective opposite sides of the mounting bracket leg 190.

In operation, when an end portion of the prestretched film has been secured to the palletized load, article, product, or package to be wrapped, and the wrapping apparatus is operated such that the rotatable ring member of the apparatus, and the mounting plate 112 fixedly mounted thereon, is rotated in the clockwise direction as view in FIG. 2 and as denoted by means of the arrow CW, the idler or dancer roller 118 will be caused or forced to move in a rectilinear manner toward the left as viewed in FIG. 2 whereby the bifurcated tines or ends 162,162 of the brake arm 160 which are engaged with the upper end 137 of the roller shaft 135 will be moved toward the left so as to accordingly cause the brake arm 160 to be pivoted in the clockwise direction as viewed in FIG. 2. This movement of the brake arm 160 will, in effect, cause a relaxation in the brake cable 170 and the brake band 158 disposed around the brake hub or pulley 114 whereby the brake hub or pulley 114 is effectively released from its braked mode so as to, in turn, effectively permit the substantially free dispensing of the prestretched plastic film material 120 from the prestretched plastic film material supply roll 117 disposed upon the brake hub or pulley 114 by means of the film arbor 116.

Figure 14:
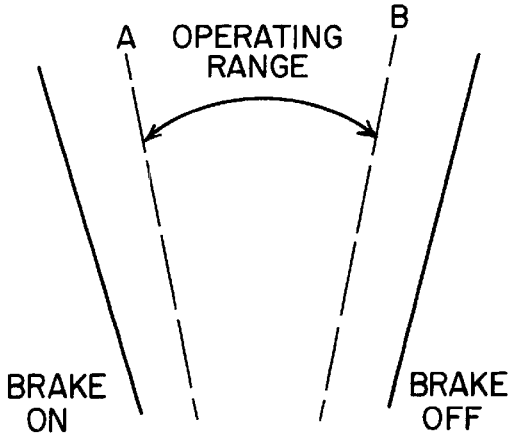
FIG. 14 is a schematic view of the brake arm component of the film delivery system showing the positional disposition of the brake arm within operative ranges of movement depending upon the amount of stretch film material disposed or remaining upon the prestretched film material supply roll.

During a particular prestretched film wrapping mode or cycle, the idler or dancer roller 118 will move in a linear reciprocating manner within its upper and lower track or channel frame members 124,126, as denoted by means of the double arrowhead R, in accordance with the biasing forces of the upper and lower coil springs disposed within the upper and lower track or channel frame members 124, 126, in accordance with the biasing forces which may be impressed upon or transmitted to the idler or dancer roller 118 from the palletized load, product, package, or article being wrapped, in accordance with biasing forces which may be impressed upon or effectively transmitted to the idler or dancer roller 118 by means of the prestretched plastic film material supply roll 117 depending upon the amount of plastic film material 120 remaining upon the prestretched plastic film material supply roll 117, and in accordance with the biasing forces transmitted to the brake arm 160 through means of the brake cable 170, the brake band 158, the brake adjustment spring 182, and the brake adjustment assembly 185. In short, the idler or dancer roller 118, through means of the brake arm 160 operatively connecting the idler or dancer roller 118 to the brake band 158, operatively cooperates with the brake band 158 so as to provide, generate, or impress substantially constant force-to-load parameters upon the prestretched plastic film material 120 as the same is conducted to the palletized load or article being wrapped. As illustrated, for example, within FIG. 14, the brake arm 160 will tend to be disposed within a particular angular operating range depending upon whether or not the prestretched film material supply roll 117 is substantially full or substantially empty, the A range denoting the brake arm movement range in connection with a substantially full supply roll, while the B range denoted the brake arm movement range in connection with a substantially empty supply roll. In any case, and again, under all of the aforenoted operating conditions, the various operative components of the film delivery system 110 of the present invention provide substantially balanced or substantially constant force-to-load characteristics. In addition, it is also readily appreciated that when the rotatable ring member of the wrapping apparatus is stopped so as to no longer rotate, the load forces impressed upon the idler or dancer roller 118 are withdrawn or are no longer present, and consequently, the coil springs disposed within the upper and lower track or channel frame members 124,126 cause the idler or dancer roller 118 to be moved to the right toward its normal extreme rightmost position as viewed in FIG. 2. As a result of this movement of the idler or dancer roller 118, the tined ends 162,162 of the brake arm 160 are caused to move to the right as viewed in FIG. 2 whereby the brake arm 160 is caused to rotate in the counterclockwise direction as viewed in FIG. 2 such that the brake band 158 again frictionally engages the outer periphery of the brake hub or pulley 114 through means of the operative connections with the brake cable 170 and the brake adjustment spring 182.

Accordingly, rotation of the prestretched plastic film material supply roll 117, as mounted upon the brake hub or pulley 14 through means of the film arbor 116, is terminated so as to, in turn, terminate the payout or dispensing of the plastic film material 120. It is lastly to be appreciated that the force-to-load characteristics may also be altered or in effect fine-tuned depending upon the particular types of springs utilized within the upper and lower track or channel frame members 124,126. In other words, by employing substantially light springs, substantially light or small force-to-load characteristics will be generated or developed. Alternatively, by employing substantially heavy springs, substantially heavy or larger force-to-load characteristics will be generated or developed.

Thus, it may be seen that in accordance with the principles and teachings of the present invention, a new and improved prestretched plastic film delivery system for use in connection with plastic film wrapping apparatus has been developed wherein substantially constant force-to-load parameters are impressed upon the plastic wrapping film during various times of a wrapping cycle, regardless of particular geometrical configurations of a particular palletized load or article being wrapped, and regardless of the amount of prestretched plastic wrapping film material disposed or remaining upon the prestretched plastic wrapping film material supply roll. In addition, the provision of the single idler or dancer roller, and the single directional reversal or 180 directional change in the prestretched plastic wrapping film material from the prestretched plastic wrapping film material supply roll to the palletized load or article being wrapped, facilitates the threading or routing of the prestretched plastic wrapping film within the film delivery system attendant, for example, the installation of a new or fresh prestretched plastic wrapping film material supply roll onto the film arbor. Still further, the provision of the highly-polished mirror-finish upon the outer peripheral surface of the idler or dancer roller obviates the need for any mechanical projections, embossments, or the like upon the outer peripheral surface of the idler or dancer roller which would otherwise adversely affect light transmission or refractive properties of the plastic wrapping film.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letter Patent of the United States of America, is:

1. A film delivery system for use in connection with film material wrapping apparatus for wrapping plastic film material around an article, comprising:

a mounting plate;

a brake hub, upon which a roll of plastic wrapping film material is adapted to be mounted, rotatably mounted upon said mounting plate and having an outer peripheral surface;

a dancer roller system, around which the plastic wrapping film material is routed toward the article to be wrapped, movably mounted upon said mounting plate; and a brake band disposed around said outer peripheral surface of said brake hub, having a first end portion thereof fixedly connected to said mounting plate, and a second end portion thereof operatively connected to said dancer roller system so as to cooperate with said dancer roller system in providing substantially constant force-to-load tension characteristics to the plastic wrapping film material throughout a plastic film material wrapping cycle performed upon the article being wrapped, wherein said brake hub has a predetermined diametrical extent which is greater than the diametrical extent of a fresh full roll of plastic wrapping film material such that said force-to-load tension characteristics provided to the plastic wrapping film material are substantially independent of the amount of plastic wrapping film material disposed upon the roll of plastic wrapping film material.

2. The system as set forth in claim 1, wherein:

a brake arm has a first end portion thereof pivotally mounted upon said mounting plate, and a second end portion thereof is operatively connected to said dancer roller system; and said second end portion of said brake band is operatively connected to said first end portion of said brake arm.

3. The system as set forth in claim 2, wherein:

said dancer roller system comprises a single dancer roller having opposite end portions of a roller shaft projecting outwardly from opposite end portions of said single dancer roller; and said second end portion of said brake arm is bifurcated such that laterally spaced tined portions of said bifurcated second end portion of said brake arm are operatively engaged with one of said opposite outwardly projecting end portions of said roller shaft.

4. The system as set forth in claim 2, wherein:

said first end portion of said brake arm is provided with a plurality of apertures within any one of which said second end portion of said brake band can be fixedly connected so as to predetermine different degrees of braking forces to be impressed upon said brake hub by means of said brake band.

5. The system as set forth in claimed 2, wherein:

a brake cable is interposed between said second end of said brake band and said brake arm so as to operatively connect said brake band to said brake arm.

6. The system as set forth in claim 1, wherein:

a brake adjustment spring is interposed between said first end of said brake band and said mounting plate, with a first end of said brake adjustment spring being operatively connected to said brake band while a second end of said brake adjustment spring is operatively connected to said mounting plate, so as to operatively connect said brake band to said mounting plate.

7. The system as set forth in claim 6, further comprising:

a mounting bracket fixedly mounted upon said mounting plate;

an adjustment screw mounted upon said mounting bracket and operatively connected to said second end of said brake adjustment spring; and a pair of nut members threadedly disposed upon said adjustment screw and disposed upon opposite sides of said mounting bracket for fixedly adjusting the disposition of said adjustment screw with respect to said mounting bracket such that a predetermined amount of tension is developed within said brake adjustment spring.

8. A film delivery system for use in connection with film material wrapping apparatus for wrapping plastic film material around an article, comprising:

a mounting plate;

a brake hub, upon which a roll of plastic wrapping film material is adapted to be mounted, rotatably mounted upon said mounting plate and having an outer peripheral surface;

a dancer roller system, around which the plastic wrapping film material is routed toward the article to be wrapped, movably mounted upon said mounting plate, wherein said dancer roller system comprises a dancer roller having a highly-polished outer peripheral surface comprising a substantially mirror-finish such that the plastic wrapping film material can adhere to said outer peripheral surface of said dancer roller during transmission of the plastic wrapping film material toward the article being wrapped; and a brake band disposed around said outer peripheral surface of said brake hub, having a first end portion thereof fixedly connected to said mounting plate, and a second end portion thereof operatively connected to said dancer roller system so as to cooperate with said dancer roller system in providing substantially constant force-to-load tension characteristics to the plastic wrapping film material throughout a plastic film material wrapping cycle performed upon the article being wrapped.

9. The system as set forth in claim 8, wherein:

said dancer roller of said dancer roller system comprises a single dancer roller around which the plastic wrapping film material is routed along a path which extends from the roll of plastic wrapping film material to the article being wrapped such that the plastic wrapping film routed around said single dancer roller undergoes a single reversal in direction so as to simplify the routing of the plastic wrapping film within said system.

10. The system as set forth in claim 8, further comprising:

a framework assembly mounting said dancer roller for linear reciprocating movements.

11. The system as set forth in claim 10, wherein said framework assembly comprises:

upper and lower track frame members;

said dancer roller has opposite end portions of a roller shaft projecting outwardly from opposite end portions of said dancer roller and respectively disposed within said upper and lower track frame members; and coil springs respectively disposed within said upper and lower track frame members for biasing said dancer roller to a normal position remote from said brake hub.

12. A film delivery system for use in connection with film material wrapping apparatus for wrapping plastic film material around an article, comprising:

a mounting plate;

a brake hub, upon which a roll of plastic wrapping film material is adapted to be mounted, rotatably mounted upon said mounting plate and having an outer peripheral surface;

a dancer roller system, comprising a dancer roller around which the plastic wrapping film material is routed toward the article to be wrapped, movably mounted upon said mounting plate;

a framework assembly mounted upon said mounting plate for mounting said dancer roller thereon such that said dancer roller undergoes linear reciprocating movements during the conveyance of the plastic wrapping film material from the roll of plastic wrapping film material to the article to be wrapped during a plastic film material wrapping cycle; and a brake band disposed around said outer peripheral surface of said brake hub, having a first end portion thereof fixedly connected to said mounting plate, and a second end portion thereof operatively connected to said dancer roller system so as to cooperate with said dancer roller system in providing substantially constant force-to-load tension characteristics to the plastic wrapping film material throughout a plastic film material wrapping cycle performed upon the article being wrapped.

13. The system as set forth in claim 12, wherein said framework assembly comprises:

upper and lower track frame members;

said dancer roller has opposite end portions of a roller shaft projecting outwardly from opposite end portions of said dancer roller and respectively disposed within said upper and lower track frame members; and coil springs respectively disposed within said upper and lower track frame members for biasing said dancer roller to a normal position remote from said brake hub.

14. The system as set forth in claim 12, wherein:

said dancer roller of said dancer roller system comprises a single dancer roller around which the plastic wrapping film material is routed along a path which extends from the roll of plastic wrapping film material to the article being wrapped such that the plastic wrapping film routed around said single dancer roller undergoes a single reversal in direction so as to simplify the routing of the plastic wrapping film within said system.

15. Film material wrapping apparatus for wrapping plastic film material around an article, comprising:

an upright framework;

a rotatable ring member rotatably mounted upon said upright framework for rotation around a vertical axis;

a mounting plate fixedly mounted upon said rotatable ring member;

a brake hub, upon which a roll of wrapping film material is adapted to be mounted, rotatably mounted upon said mounting plate and having an outer peripheral surface;

a dancer roller system, around which the plastic wrapping film material is routed toward the article to be wrapped, movably mounted upon said mounting plate; and a brake band disposed around said outer peripheral surface of said brake hub, having a first end portion thereof fixedly connected to said mounting plate, and a second end portion thereof operatively connected to said dancer roller system so as to cooperate with said dancer roller system in providing substantially constant force-to-load tension characteristics to the plastic wrapping film material throughout a plastic film material wrapping cycle performed upon the article being wrapped, wherein said brake hub has a predetermined diametrical extent which is greater than the diametrical extent of a fresh full roll of plastic wrapping film material such that said force-to-load tension characteristics provided to the plastic wrapping film material are substantially independent of the amount of plastic wrapping film material disposed upon the roll of plastic wrapping film material.

16. The apparatus as set forth in claim 15, wherein:

a brake arm has a first end portion thereof pivotally mounted upon said mounting plate, and a second end portion thereof is operatively connected to said dancer roller system; and said second end portion of said brake band is operatively connected to said first end portion of said brake arm.

17. The apparatus as set forth in claim 16, wherein:

said dancer roller system comprises a single dancer roller having opposite end portions of a roller shaft projecting outwardly from opposite end portions of said single dancer roller; and said second end portion of said brake arm is bifurcated such that laterally spaced tined portions of said bifurcated second end portion of said brake arm are operatively engaged with one of said opposite outwardly projecting end portions of said roller shaft.

18. The apparatus as set forth in claim 16, wherein:

said first end portion of said brake arm is provided with a plurality of apertures within any one of which said second end portion of said brake band can be fixedly connected so as to predetermine different degrees of braking forces to be impressed upon said brake hub by means of said brake band.

19. The apparatus as set forth in claim 16, wherein:

a brake cable is interposed between said second end of said brake band and said brake arm so as to operatively connect said brake band to said brake arm.

20. The apparatus as set forth in claim 15, wherein:

a brake adjustment spring is interposed between said first end of said brake band and said mounting plate, with a first end of said brake adjustment spring being operatively connected to said brake band while a second end of said brake adjustment spring is operatively connected to said mounting plate, so as to operatively connect said brake band to said mounting plate.

21. The apparatus as set forth in claim 20, further comprising:

a mounting bracket fixedly mounted upon said mounting plate;

an adjustment screw mounted upon said mounting bracket and operatively connected to said second end of said brake adjustment spring; and a pair of nut members threadedly disposed upon said adjustment screw and disposed upon opposite sides of said mounting bracket for fixedly adjusting the disposition of said adjustment screw with respect to said mounting bracket such that a predetermined amount of tension is developed within said brake adjustment spring.

22. Film material wrapping apparatus for wrapping plastic film material around an article, comprising:

an upright framework;

a rotatable ring member rotatably mounted upon said upright framework for rotation around a vertical axis;

a mounting plate fixedly mounted upon said rotatable ring member;

a brake hub, upon which a roll of wrapping film material is adapted to be mounted, rotatably mounted upon said mounting plate and having an outer peripheral surface;

a dancer roller system, around which the plastic wrapping film material is routed toward the article to be wrapped, movably mounted upon said mounting plate, wherein said dancer roller system comprises a dancer roller having a highly-polished outer peripheral surface comprising a substantially mirror-finish such that the plastic wrapping film material can adhere to said outer peripheral surface of said dancer roller during transmission of the plastic wrapping film material toward the article being wrapped; and a brake band disposed around said outer peripheral surface of said brake hub, having a first end portion thereof fixedly connected to said mounting plate, and a second end portion thereof operatively connected to said dancer roller system so as to cooperate with said dancer roller system in providing substantially constant force-to-load tension characteristics to the plastic wrapping film material throughout a plastic film material wrapping cycle performed upon the article being wrapped.

23. The apparatus as set forth in claim 22, wherein:

said dancer roller system comprises a single dancer roller around which the plastic wrapping film material is routed along a path which extends from the roll of plastic wrapping film material to the article being wrapped and which comprises a single reversal in direction so as to simplify the routing of the plastic wrapping film within said system.

24. The apparatus as set forth in claim 22, further comprising:

a framework assembly mounting said dancer roller for linear reciprocating movements.

25. The apparatus as set forth in claim 24, wherein said framework assembly comprises:

upper and lower track frame members;

said single dancer roller has opposite end portions of a roller shaft projecting outwardly from opposite end portions of said dancer roller and respectively disposed within said upper and lower track frame members; and coil springs respectively disposed within said upper and lower track frame members for biasing said dancer roller to a normal position remote from said brake hub.

26. Film material wrapping apparatus for wrapping plastic film material around an article, comprising:

an upright framework;

a rotatable ring member rotatably mounted upon said upright framework for rotation around a vertical axis;

a mounting plate fixedly mounted upon said rotatable ring member;

a brake hub, upon which a roll of wrapping film material is adapted to be mounted, rotatably mounted upon said mounting plate and having an outer peripheral surface;

a dancer roller system, comprising a dancer roller around which the plastic wrapping film material is routed toward the article to be wrapped, movably mounted upon said mounting plate;

a framework assembly mounted upon said mounting plate for mounting said dancer roller thereon such that said dancer roller undergoes linear reciprocating movements during the conveyance of the plastic wrapping film material from the roll of plastic wrapping film material to the article to be wrapped during a plastic film material wrapping cycle; and a brake band disposed around said outer peripheral surface of said brake hub, having a first end portion thereof fixedly connected to said mounting plate, and a second end portion thereof operatively connected to said dancer roller system so as to cooperate with said dancer roller sys system in providing substantially constant force-to-load tension characteristics to the plastic wrapping film material throughout a plastic film material wrapping cycle performed upon the article being wrapped.

27. The apparatus as set forth in claim 26, wherein said framework assembly comprises:

upper and lower track frame members;

said dancer roller has opposite end portions of a roller shaft projecting outwardly from opposite end portions of said dancer roller and respectively disposed within said upper and lower track frame members; and coil springs respectively disposed within said upper and lower track frame members for biasing said dancer roller to a normal position remote from said brake hub.

28. The apparatus as set forth in claim 26, wherein:

said dancer roller of said dancer roller system comprises a single dancer roller around which the plastic wrapping film material is routed along a path which extends from the roll of plastic wrapping film material to the article being wrapped such that the plastic wrapping film routed around said single dancer roller undergoes a single reversal in direction so as to simplify the routing of the plastic wrapping film within said system.

* * * * *